United States Patent [19]

Jerenz

[11] Patent Number: 4,944,966

[45] Date of Patent: Jul. 31, 1990

[54] PROCESS FOR THE HARDENING OF PHOTOGRAPHIC GELATIN COATINGS AND A COMPOSITE HARDENER FOR GELATIN-CONTAINING COATINGS

[75] Inventor: Hans Jerenz, Osnabruck, Fed. Rep. of Germany

[73] Assignee: Felix Schoeller Jr. GmbH & Co. KG, Fed. Rep. of Germany

[21] Appl. No.: 232,933

[22] Filed: Aug. 16, 1988

[30] Foreign Application Priority Data

Aug. 17, 1987 [DE] Fed. Rep. of Germany ..... 3727293

[51] Int. Cl.[5] ..... B05D 3/02

[52] U.S. Cl. ..... 427/397; 430/539; 430/642; 530/354

[58] Field of Search ..... 430/539, 642; 530/354; 427/391

[56] References Cited

U.S. PATENT DOCUMENTS 4,232,111 11/1980 Miyazako et al. ..... 430/434 X

*Primary Examiner*—Michael Lusignan

*Attorney, Agent, or Firm*—Allegretti & Witcoff, Ltd.

[57] ABSTRACT

A novel hardening agent for photographic gelatin coatings comprising a composite solution of a substituted 1,3,5 triazine and formaldehyde, in which the ratio of triazine to formaldehyde ranges from 1:0.1 to 1:0.7. The hardening agent may be added to the gelatin coating in the amount of 0.5 to 4 weight % based upon the gelatin content.

5 Claims, No Drawings

PROCESS FOR THE HARDENING OF PHOTOGRAPHIC GELATIN COATINGS AND A COMPOSITE HARDENER FOR GELATIN-CONTAINING COATINGS

BACKGROUND OF THE INVENTION

Gelatin is used in most photographic materials in the production of silver halide emulsions, protective coatings and the backing coatings. However, gelatin coats swell in contact with water and their mechanical strength, in a swollen condition, is greatly reduced. They are therefore usually strengthened by using a suitable hardener (hardening agent). These hardeners cross-link the gelatin molecules with each other and therefore reduce the water-absorption, and subsequently swelling, qualities of the coating, they raise the melting point and improve the mechanical strength of the gelatin coating. Hardened gelatin coatings are, above all, resistant to photograhic processing solutions.

Among others the most common hardening agents in photographic coatings are chromium (III)-salts, aldehydes, dialdehyde polysaccarides, polyfunctional epoxides, aziridines, polyfunctional vinyl compounds, triacryl formal, substituted dichlor-s-triazine, as well as other substances as described in chapter 2 of "The Theory of the Photographic Process" by T. H. James (London, 1977).

These hardeners are either added to a gelatin-containing solution before the coating process, or applied, as a special coating, to a gelatin-containing layer already on the support material. In the later case the hardener diffuses into the gelatin layer where it reacts with the peptide chains. Both processes may be combined in as much as a percentage of the hardener is added to the gelatin solution and the rest applied to the coat later.

THE PRIOR ART

All the usual substances used as hardening agents are applied in specific areas and are not perfectly suited to applications in other areas, i.e., all known hardeners have one or more disadvantages. Aliphatic aldehydes and diketones do not make suitable coatings for color photography, as they are reactive with the usual color coupling components or other emulsion additives. Polyepoxides, triazines and polysaccharides are suitable for color photography coatings, but react very slowly which makes them unsuitable for gelatin coatings which need to be resistant shortly after drying as when for instance a further coating process is necessary. Other hardeners, such as chromium salts, react so rapidly that a gelatin solution to which they have been added shows an increase in viscosity even during the coating process which makes this more difficult and under certain circumstances sets a time limit for coating. Still other hardeners are not satisfactorily diffusion resistant and modify the hardness of their neighboring coatings when stored or the application is restricted due to health reasons, one of which is, e.g., divinyl sulfone.

Every known hardener to date has some disadvantage or other and cannot be used to a wide range of applications as is desirable above all in gelatin auxiliary coatings applied to a base support before emulsioning and later to be brought into contact with the actual photographic coating. The main disadvantage, however, remains that most hardeners react too slowly with gelatin and further processing of the coated material is often only possible after days or even weeks of storage.

THE INVENTION

It is therefore an object of the present invention to provide a process for the hardening of gelatin coatings as well as a hardener which does not have the previously described disadvantages. A special object of the invention is to provide a hardener for gelatin coatings suitable for color-photography materials which hardens gelatin coatings quickly so that only a few hours after the coat has dried further processing is possible, be it in the form of an additional coating or a developing and fixing. Furthermore during the processing of the gelatin solution containing the hardener there is to be no undesirable increase in the viscosity of the solution.

The problem is solved according to the present invention by preparing a premix consisting of a known hardener of the triazine type and formaldehyde to form a composite hardener and adding this hardener to the gelatin solution before coating, be this a photographic emulsion or an auxiliary coating. A substantial part of the success of the invention is based on aging the premix, preferably at room temperature, thereby reacting to an unknown composite, before being stirred in to the gelatin solution. The time of aging preferably is at least one hour.

This gelatin solution containing the composite hardener is then to be processed in the usual way and without unreasonable delay. All the usual single or multiple coating and dosing procedures may be used, such as curtain coating, doctor coating, roll coating, gravure coating, dip coating, kiss coating or others, with following air brush or bar levelling if necessary.

The composite hardener according to the invention may be used to great advantage in auxiliary coatings containing gelatin, which, in turn, serve as, e.g., adhesive coatings, anti-curl coatings, protective coatings or antistatic coatings because after drying and short reheating they are then hard enough to accept a further coating.

The composite hardener according to the invention can be used in all photographic emulsions. It can be used together with other known hardeners as long as these hardeners are not undesirable on the grounds of general or photographic reasons. Suitable additional hardeners may be chromium salts, dialdehyde compounds, aziridine compounds or even vinyl sulfone derivatives. Furthermore the gelatin coatings to be hardened may contain the usual additives such as wetting agents, plasticizers, antistatic agents, matting agents, colorants, pigments, etc.

According to the invention the production of the novel composition is as follows: An aqueous or aqueous alcoholic solution of the triazine derivative (TAF) is mixed with formaldehyde solution so that the ratio of TAF to formaldehyde is between 1 to 0.1 and 1 to 0.7. After standing for at least one hour (during which a reaction may have taken place, but this was not confirmed) this composition is added to a gelatin solution in a quantity of between 0.5 to 4 weight % TAF plus formaldehyde based on the gelatin content. It is necessary for the solution to undergo an aging or standing time of an hour or more, preferably at room temperature. But differing temperatures during aging time are almost irrelevant. The aging time may be increased to as much as several days or even weeks but one hour at nearly room temperature is to be regarded as a minimum under which is worsening of the hardening effect of the gelatin can be expected.

This result is all the more surprising as the hardening effect of the invention's composite hardener is noticeably better than those of the single components. Moreover it was shown that in the color emulsions of the preparation according to the invention the formaldehyde (in itself harmful) did not develop any harmful effects. It is furthermore advantageous that the described combination may be used and is effective in the whole pH-range lower than pH 7.

SPECIFIC EXAMPLES

The invention is described in more detail in the following specific examples.

EXAMPLE 1

Each base paper sample (1*a* to 1*h*) coated on both sides with polyethylene underwent a corona pre-treatment of the backside and was then coated on the backside with one gelatin anti-curling coat. The anti-curling coat was made up of an aqueous gelatin solution at pH 6, having a gelatin content of 7% by weight, a saponin content of 0.5% by weight and the hardeners H1 to H3, the quantities of which are shown in Table 1. These hardeners H1 to H3 are composite hardeners prepared according to the invention:

H1=1,3,5-Triacryloyl-Hexahydro-s-Triazine (TAF) with formaldehyde in a ratio of 1 to 0.2;

H2=1,3,5-Triacryloyl-Hexahydro-s-Triazine (TAF) with formaldehyde in a ratio of 1 to 0.4;

H3=1,3,5-Triacryloyl-Hexahydro-s-Triazine (TAF) with formaldehyde in a ratio of 1 to 0.6.

The composite hardeners were prepared as follows: To 2% TAF solution in water was added a quantity of 10% formaldehyde solution sufficient to produce the ratios for H1, H2, and H3. The mixture was then left to stand for 2 hours at room temperature. Thereafter it is added to the gelatin solution in the quantities given in Table 1.

The gelatin solution containing the composite hardener was then applied to the pre-treated base paper samples in the usual way and in such quantities that after setting and drying an anti-curl coating of 5 g/m$^2$ resulted. This was examined with a view to both the melting point and the photo-chemical characteristics. The results thereof can be seen in Table 1.

COMPARATIVE EXAMPLE V 1

Base paper samples (V 1*i* to V 1*p*) coated on both sides with polyethylene were treated as in example 1 and the pre-treated backsides were coated with a gelatin solution. In contrast to example 1, the hardeners H4 to H9 were added in quantities shown in Table 1 and the resulting coatings were similarly examined as the coatings in example 1. These results are also shown in Table 1.

The hardening agents used in V 1*i* to V 1*p* are as follows:

H4=1,3,5-triacryloyl-hexahydro-s-triazine (TAF),
H5=formaldehyde,
H6=TAF and formaldehyde (1 to 0.2),
H7=TAF and formaldehyde (1 to 0.4),
H8=TAF and formaldehyde (1 to 0.6),
H9=chrome alum.

In the cases H6 to H8 the components TAF and formaldehyde were added singly, one after the other to the gelatin solution.

TABLE 1

Hardening agent additives and examination results on the gelatin coats according to example 1 and comparative example V 1

| Sample No. | Hardening agent | Quantity of hardening agent (% weight of gelatin content) | Melting point of coat (°C.) in water: after coating | after 24 hours incubation at 50° C. in 40% humidity | after 8 days natural storage | Remarks |
|---|---|---|---|---|---|---|
| 1a | H 1 | 0,6 | 50 | 95 | 72 | — |
| 1b | H 1 | 1,2 | 58 | >99 | 78 | — |
| 1c | H 1 | 1,8 | 68 | >99 | 86 | — |
| 1d | H 2 | 0,6 | 54 | 95 | 70 | — |
| 1e | H 2 | 1,2 | 62 | >99 | 80 | — |
| 1f | H 2 | 1,8 | 69 | >99 | 88 | — |
| 1g | H 3 | 1,0 | 60 | >99 | 79 | — |
| 1h | H 3 | 1,8 | 68 | >99 | 93 | — |
| V 1i | H 4 | 1,8 | 35 | 90 | 48 | — |
| V 1k | H 5 | 1,2 | 54 | 76 | 65 | fogging with color coats |
| V 11 | H 5 | 1,8 | 60 | 88 | 81 | fogging with color coats |
| V 1m | H 6 | 1,8 | 44 | 90 | 64 | — |
| V 1n | H 7 | 1,8 | 45 | 89 | 66 | — |
| V 1o | H 8 | 1,8 | 45 | 90 | 66 | sl. fogging |
| V 1p | H 9 | 1,8 | 63 | 82 | 72 | noticeable rise in viscosity & deposits on coating equipment |

EXAMPLE 2

A common black/white photographic emulsion with a gelatin content of 5% weight, as used in example 1 and described in the German patent No. 1 140 813, was mixed with a hardening solution according to Table 2 and dip-coated on to a base paper already coated on both sides with polyethylene and was cooled and dried in the usual manner.

The hardening solution was produced using a 2% weight TAF-solution with differing quantities of formaldehyde solution (10% weight). The mixture was left to stand 3 hours at room temperature and mixed in to the emulsion in the quantities given in Table 2.

For comparisons within example 2 there are the tests 2k and 2l in which only TAF or formaldehyde were used as hardening agents (see Table 2).

EXAMPLE 3

The tests of example 2 were repeated, the difference being that the emulsion contained additionally 4 ml of a 2% aqueous carbamide solution, as a hardening accelerator.

This small quantity of carbamide additive accelerated the hardening process to such an extent that all the applied coatings tested from 3a to 3i inclusive were, after 8 days, hardened to a degree where their melting point was higher than 99° C. This carbamide additive is useful only in black/white emulsions as this quantity of carbamide produces fog in color coatings.

TABLE 2

Hardening of a black/white emulsion with TAF/formaldehyde composites as in example 2 and comparisons

| Sample No. | Hardening agent content (ml of formalin (10%) per 100 ml TAF (at 2%) | Additive quantity (ml) per 1 l emulsion | Melting point (°C.) after coating | Melting point (°C.) after 8 days storage | HCHO-fogging in contact with color layer (1) |
|---|---|---|---|---|---|
| 2a | 3 | 20 | 47 | 76 | no |
| 2b | 5 | 20 | 49 | 75 | no |
| 2c | 10 | 20 | 48 | 76 | no |
| 2d | 3 | 30 | 52 | 79 | no |
| 2e | 5 | 30 | 51 | 80 | no |
| 2f | 10 | 30 | 51 | 78 | no |
| 2g | 3 | 40 | 58 | 90 | no |
| 2h | 5 | 40 | 57 | 89 | no |
| 2i | 10 | 40 | 57 | 88 | no |
| 2k (comp.) | 0 | 40 | 33 | 50 | no |
| 2l (comp.) | only formalin (10%) | 15 | 55 | 72 | yes |

(1) Common color photographic paper incubated in contact with a freshly dried emulsion layer for 5 days at 50° C., and then together with a similarly treated bling test developed and fixed and the fog compared to the fog of the bling test.

EXAMPLE 4

The pre-treated backside of coating support samples as in example 1 received a gelatin coating. Differing from example 1, the following triazines were used for the hardening agent composites.

4a - Sodium salt of 2-Hydroy-4,6-dichloro-s-triazine
4b - 2-Hydroxy-4,6-diacryloyl-s-triazine
4c - Acryloyloxyethylaminedichloro-s-triazine
4d - 5-Acetyl-1,3-diacryloylhexahydro-s-triazine
4f - 1,3,5-tri(β-vinylsulfonyl)propionyl-hexahydro-s-triazin A 10 weight-% formaldehyde solution with a ratio of 0.5 weight parts formaldehyde to 1 weight part of a triazine was added to a 2% weight solution of each of these triazines. The mixture was left to stand at room temperature for 3 hours. Whereafter a quantity of this premix was added to the gelatin solution of each sample so that the additional quantity, in each case, amounted to 2% weight hardener based on the gelatin content.

The gelatin solutions were then roller-washed on to the corona-pre-treated backsides and equalized and dozed by airbrushing so that after drying the coating weight was approx. 5 g/m$^2$. Drying was carried out in a tunnel drier at air temperatures beginning with 30° C. and increasing to 80° C.

Examination of the melting points of the coating after 8 days of natural storage produced the following results:

4a: 80° C.
4b: 85° C.
4c: 83° C.
4d: 83° C.
4f: 90° C.

The examples 1 to 4 including Tables 1 and 2 show that when hardening a gelatin-containing coat, it is advantageous to use a premix of triazine and formaldehyde as a composite hardener. Examination of all the coated samples containing this premix shortly after drying showed that the melting temperatures were above 45° C. This is the minimum temperature necessary to enable immediate further processing. As little as 2 weeks of natural storage were adequate to raise these melting temperatures to above 99° C., a result which could not be achieved simply by adding, singly, corresponding quantities of triazine and formaldehyde.

It is of noticeable advantage that the composite hardeners according to the invention have a wide range of applications and are not only suitable for black/white materials but also for color.

What is claimed is:

1. A process for hardening gelatin-containing photographic coatings and auxiliary coatings using an organic hardener comprising:

preparing a premix hardening agent comprising a solution of an effective amount of a substituted 1,3,5 triazine and formaldehyde;

aging said premix hardening agent at least one hour;

adding said premix hardening agent to a photographic gelatin-containing solution after said aging of said premix hardening agent; and coating a paper base with said gelatin-containing solution containing the premix hardening agent.

2. The process of claim 1 in which the ratio of substituted triazine to formaldehyde in said premix hardening agent ranges from 1:0.1 to 1:0.7.

3. The process of claims 1 or 2 wherein said premix hardening agent is added to said gelatin-containing solution in a quantity of 0.5 to 4% based upon the gelatin content.

4. The process of claims 1 or 2 wherein said gelatin-containing solution contains an additional hardener taken from the group consisting of chromium salts, dialdehyde compounds, aziridine compounds and vinyl sulfone derivatives.

5. The process of claims 1 or 2 wherein said gelatin-containing solution contains carbamide as a hardening accelerator.

* * * * *